US011578014B1

(12) United States Patent
Mills et al.

(10) Patent No.: US 11,578,014 B1
(45) Date of Patent: Feb. 14, 2023

(54) PROCESS FOR PREPARING PYROPHORIC FOAM GRANULES

(71) Applicant: U.S. Government as Represented by the Secretary of the Army, Dover, NJ (US)

(72) Inventors: Kendall Mills, Blairstown, NJ (US); Zhaohua Luan, Ledgewood, NJ (US); Juan Patino, West Milford, NJ (US); Lauren Morris, Midland Park, NJ (US); Giuseppe L. DiBenedetto, Nutley, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 447 days.

(21) Appl. No.: 16/729,718

(22) Filed: Dec. 30, 2019

(51) Int. Cl.
*C06B 21/00* (2006.01)

(52) U.S. Cl.
CPC ..... *C06B 21/0075* (2013.01)

(58) Field of Classification Search
CPC ..... C06B 21/0075; C06C 15/00
See application file for complete search history.

(56) References Cited

U.S. PATENT DOCUMENTS

| | | | | |
|---|---|---|---|---|
| 4,585,600 | A * | 4/1986 | Rollyson | C06B 21/0075 83/365 |
| 5,068,066 | A * | 11/1991 | Muller | C06B 21/0075 264/3.3 |
| 5,565,150 | A * | 10/1996 | Dillehay | C06B 21/0075 264/3.3 |
| 10,059,637 | B2 | 8/2018 | Luan | |
| 2004/0011235 | A1* | 1/2004 | Callaway | F42B 4/26 102/336 |
| 2015/0291446 | A1* | 10/2015 | Addiego | B01J 20/28011 252/178 |
| 2016/0207777 | A1* | 7/2016 | Fagan | C01B 32/342 |
| 2017/0137340 | A1* | 5/2017 | Luan | C06C 15/00 |
| 2020/0407288 | A1* | 12/2020 | Davis | C06C 15/00 |

* cited by examiner

*Primary Examiner* — Jerzi H Moreno Hernandez
(74) *Attorney, Agent, or Firm* — John P. DiScala

(57) ABSTRACT

The present invention is directed to preparing pyrophoric foam granules having a specific infrared signature comprising the steps of (a) mixing a composition comprising a metal salt, carbohydrate, and wetting agent into a homogenous paste, (b) extruding the composition into strands, (c) cutting or spheronizing the strands into a predetermined size or length based on a specific thermal or infrared response to produce pyrophoric foam granules and (d) activating the granules by heating the composition at elevated temperatures under an inert or reducing atmosphere until the matrix is carbonized and the metal salt is reduced.

1 Claim, No Drawings

PROCESS FOR PREPARING PYROPHORIC FOAM GRANULES

RIGHTS OF THE GOVERNMENT

The inventions described herein may be manufactured and used by or for the United States Government for government purposes without payment of any royalties.

FIELD OF INVENTION

The present invention relates generally to pyrophoric countermeasures and more specifically methods to prepare tunable pyrophoric countermeasures.

BACKGROUND OF THE INVENTION

The present invention is directed to air countermeasures that act as an infrared or thermal signature decoy. Typically, such countermeasures are composed of chemically activated metal foil, pyrophoric metal powders, and phosphorous.

U.S. Pat. No. 10,059,637 issued to Luan et al, discloses methods to prepare pyrophoric foam materials by embedding the pyrophoric material into a matrix material and casting it into a desired shape. Luan et al did not disclose how to produce a form factor that can be tailored or tuned in response to a specific thermal or infrared threat.

The present invention seeks to overcome some of these drawbacks by producing a shape factor that can be tailored in response to specific thermal and infrared applications. The process for producing such countermeasure also allows for rapid and bulk production.

SUMMARY OF THE INVENTION

It is an object of the invention to provide for methods to prepare tunable pyrophoric materials that can be tuned in response to a particular thermal or infrared threat. Such methods allow for rapid and bulk production of pyrophoric countermeasures that improve upon the available state of the art products. In one aspect of the invention, a metal salt, carbohydrate and wetting agent are mixed into a homogenous mass which is then extruded into strands. The strands are cut into predetermined lengths based on the desired thermal or infrared signature. The granules are then activated under high temperatures in an inert atmosphere.

DETAILED DESCRIPTION

Disclosed herein is an invention directed to preparing tunable pyrophoric foam granules having a specific thermal or infrared signature comprising the steps of (a) mixing a composition comprising a metal salt, carbohydrate, and wetting agent into a homogenous paste, (b) extruding the composition mix into strands, (c) cutting or spheronizing the strands into a predetermined size or length based on a specific thermal and infrared response to produce the pyrophoric granules and (d) activating the granules by heating the homogenous composition at elevated temperatures under an inert or reducing atmosphere until the matrix is carbonized and the metal salts are reduced into pyrophoric particles.

In the present invention, the metals salts are inorganic metal salts of iron, aluminium, bismuth, boron, calcium, hafnium, iron, magnesium, manganese, tin, titanium, cobolt, uranium, zinc, zirconium, etc. Specific examples of the inorganic metal salts include, not limited to, iron oxalate dihydrate and aluminium sulfate. A preferred precursor metal is iron oxalate dihydrate.

The carbohydrate component can be composed of any carbohydrates such as starches, flour and the like.

Wetting agent may be used to agglomerate the carbohydrate and metal granules into a plastic mass that is cohesive and formable. Selection of the wetting agent is based on solubility of the reactants, working temperature and flow properties. Exemplary wetting agents are water, ethylene glycol, polyethylene glycol, propylene glycol, and alcohols (ethyl, methyl etc.) with grater being the preferred wetting agent.

Mix the pyrophoric foam composition until homogenous and extruded it into strands, measure and cut the strands into predetermined lengths to form granules. The diameter and length of the strands can vary depending on the specific thermal or infrared signature desired. Any method to extrude the composition is permissible so long as the integrity of the strands are maintained in a shape allowable for further processing into granules. The granules are activated by heating the granules to about 400° C. to about 800° C. under an inert or reducing atmosphere (e.g nitrogen rich gas) to produce activated pyrophoric foam granules wherein the metal salt is activated into pyrophoric particles that are embedded within the carbohydrate matrix. Such granules can be stored under inert atmosphere conditions until ready to use.

The following is an exemplary process for preparing pyrophoric granules.

Example 1

Pyrophoric granules are prepared by weighing out 2 parts iron oxalate dihydrate to I part flour (2:1 ratio) and placing them into a large stand-mixing bowl and uniformly mixed. The final weight of the dry components can be a maximum of 1 kg. Water is added at 38 grams for every 100 grams of the dry mixture. The water can be streamed into the bowl as the mixer continues to run. The mixture is kneaded into a homogenous doughy mass with sufficient texture to allow for extrusion. The homogenous mixture is placed into an extrusion device fitted with a die with holes that are about 3.2 mm in diameter. Any commercial extrusion machine is acceptable for the process described herein. In this particular process a commercial pasta making extrusion machine available from OMCAN, Model # TR50 is used. Strands of the homogenous mixture are extruded and left to dry overnight in 80° C. The dried strands are removed, allowed to cool then cut into final sizes to make pyrophoric granules. The pyrophoric granules are activated by exposing the granules to high temperature under an inert or reducing atmosphere to carbonize the matrix and reduce the metal precursor prior to loading the granules into dispensing cartridges.

Example 2

In another embodiment, the pyrophoric composition can be spheronized into spheres. Spheronization creates highly uniform spherical beads as the granular final product. This is usually achieved by first extruding plastic strands similar to the method described in Example 1, which is then tumbled or agitated on a spinning disc which breaks the plastic strands apart, smooths and rounds the granules into spherical shapes. These spheres are proportional to, and usually the same size as the diameter of the extruded strands. This allows one to easily adjust the final spherical size for the desired application. The spheres are further activated under high temperatures in an inert atmosphere.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description but by the claims and any equivalents.

What is claimed is:

1. A method for making pyrophoric foam granules spheres comprising:

mixing iron oxalate, flour and water to form a homogenous mixture wherein the ratio of iron oxalate to flour is 2:1 by weight; and extruding the homogenous mixture into strands;

spheronizing the strands into spheres having a predetermined size, wherein the size provides a specific infrared signature; and reducing the iron oxalate embedded in the spheres into pyrophoric particles and carbonizing the flour by exposing the spheres to temperatures between 400 degrees Celsius and 800 degrees Celsius under an inert atmosphere.

* * * * *